US011591939B2

(12) United States Patent
Matsuoka

(10) Patent No.: US 11,591,939 B2
(45) Date of Patent: Feb. 28, 2023

(54) COMPRESSION RELEASE MECHANISM AND INTERNAL COMBUSTION ENGINE INCLUDING THE SAME

(71) Applicant: YAMAHA HATSUDOKI KABUSHIKI KAISHA, Iwata (JP)

(72) Inventor: Yoshinori Matsuoka, Shizuoka (JP)

(73) Assignee: YAMAHA HATSUDOKI KABUSHIKI KAISHA, Iwata (JP)

( * ) Notice: Subject to any disclaimer, the term of this patent is extended or adjusted under 35 U.S.C. 154(b) by 0 days.

(21) Appl. No.: 17/667,249

(22) Filed: Feb. 8, 2022

(65) Prior Publication Data

US 2022/0268184 A1 Aug. 25, 2022

(30) Foreign Application Priority Data

Feb. 24, 2021 (JP) ..... JP2021-027187

(51) Int. Cl.

| | |
|---|---|
| ***F01L 13/08*** | (2006.01) |
| ***F01L 1/047*** | (2006.01) |
| ***F01L 1/053*** | (2006.01) |
| ***F01L 1/46*** | (2006.01) |

(52) U.S. Cl.

CPC ..... *F01L 13/08* (2013.01); *F01L 1/047* (2013.01); *F01L 1/0532* (2013.01); *F01L 1/46* (2013.01); *F01L 13/085* (2013.01); *F01L 2001/0475* (2013.01); *F01L 2820/035* (2013.01)

(58) Field of Classification Search

CPC . F01L 1/047; F01L 2001/0475; F01L 1/0532; F01L 1/46; F01L 13/08; F01L 13/085; F01L 2820/035

USPC ..... 123/90.27, 90.6

See application file for complete search history.

(56) References Cited

U.S. PATENT DOCUMENTS

| | | | | |
|---|---|---|---|---|
| 3,395,689 A * | 8/1968 | Kruse | F01L 13/085 | 123/90.15 |
| 5,687,683 A * | 11/1997 | Knoblauch | F01L 13/085 | 123/182.1 |
| 2001/0023673 A1* | 9/2001 | Suzuki | F01L 13/08 | 123/90.15 |
| 2002/0078915 A1* | 6/2002 | Schneider | F01L 13/085 | 123/90.6 |
| 2002/0157631 A1* | 10/2002 | Kawamoto | F01L 13/085 | 123/182.1 |
| 2004/0261744 A1* | 12/2004 | Tsutsumi | F01L 13/085 | 123/182.1 |

(Continued)

*Primary Examiner* — Jorge L Leon, Jr.
(74) *Attorney, Agent, or Firm* — Rabin & Berdo, P.C.

(57) ABSTRACT

A compression release mechanism including a camshaft, a cam provided on the camshaft and protruding outward in a radial direction of the camshaft, a lever, of which a portion is disposed in the camshaft, a support shaft supporting the lever such that the lever is swingable between a first position and a second position relative to the camshaft, and a spring attached to the camshaft, to urge the lever toward the first position. The lever includes a cam portion configured to protrude out from the camshaft with the lever at the first position, a centrifugal weight for moving the lever toward the second position in accordance with rotation of the camshaft, and an abutment portion configured to be in abutment with an inner peripheral surface of the camshaft with the lever at the first position, and be located away from the inner peripheral surface with the lever at the second position.

12 Claims, 6 Drawing Sheets

(56) References Cited

U.S. PATENT DOCUMENTS

| | | | | |
|---|---|---|---|---|
| 2006/0048736 | A1* | 3/2006 | Sugiura | F01L 13/085<br>123/182.1 |
| 2010/0077980 | A1 | 4/2010 | Havlik et al. | |

* cited by examiner

COMPRESSION RELEASE MECHANISM AND INTERNAL COMBUSTION ENGINE INCLUDING THE SAME

CROSS REFERENCE TO RELATED APPLICATIONS

This application claims the benefit of priority to Japanese Patent Application No. 2021-027187 filed on Feb. 24, 2021. The entire contents of this application are incorporated herein by reference.

BACKGROUND OF THE INVENTION

1. Field of the Invention

The present invention relates to compression release mechanisms and internal combustion engines including the compression release mechanisms.

2. Description of the Related Art

Internal combustion engines including compression release mechanisms with the aim of facilitating the starting of the internal combustion engines, for example, are known in the related art. Such a compression release mechanism is disclosed in, for example, US 2010/0077980 A1.

As illustrated in FIGS. 6 and 7, the compression release mechanism disclosed in US 2010/0077980 A1 includes a camshaft 1060 and a lifter 1080. As illustrated in FIG. 6, the camshaft 1060 is provided with a long and narrow groove 900. A lever 1000 is disposed in the groove 900. The lever 1000 is assembled to the camshaft 1060 through a support pin 1010. As illustrated in FIG. 7, the lever 1000 is swingable around the support pin 1010. The lever 1000 includes: a protrusion 1030 that comes into abutment with the lifter 1080; a portion 1035 in contact with a spring 1040; and a counter weight 1020.

Before the starting of an internal combustion engine, the protrusion 1030 is in abutment with the lifter 1080. After the starting of the internal combustion engine, the rotational speed of the camshaft 1060 exceeds a predetermined value, so that centrifugal force acting on the counter weight 1020 increases. This results in counterclockwise rotation of the lever 1000 around the support pin 1010 as indicated by the arrow in FIG. 7. Accordingly, the protrusion 1030 is moved out of a position directly below the lifter 1080 and brought out of abutment with the lifter 1080. Thus, the number of times a valve opens and closes or a period of time during which the valve is open per rotation of the camshaft 1060 differs between before and after the starting of the internal combustion engine.

The compression release mechanism disclosed in US 2010/0077980 A1 is arranged such that a major portion of the lever 1000 is disposed inside the camshaft 1060. This arrangement enables the compression release mechanism disclosed in US 2010/0077980 A1 to be smaller in size than a compression release mechanism whose lever 1000 is disposed in its entirety outside the camshaft 1060.

In the compression release mechanism disclosed in US 2010/0077980 A1, an urging force of a valve spring (not illustrated) is transmitted to the support pin 1010 through the lifter 1080 before the starting of the internal combustion engine. Because the support pin 1010 receives the urging force of the valve spring, the support pin 1010 needs to have sufficiently high rigidity. This makes it necessary to increase the thickness of the support pin 1010 or enhance the strength of portion(s) of the camshaft 1060 supporting the support pin 1010. Taking such measures, however, becomes a factor that increases the size or weight of the resulting compression release mechanism.

SUMMARY OF THE INVENTION

Accordingly, preferred embodiments of the present invention provide a new compression release mechanism reduced in size or weight and an internal combustion engine including the compression release mechanism.

A compression release mechanism disclosed herein includes a camshaft, a cam, a lever, a support shaft, and a spring. The camshaft includes: a peripheral wall provided with an opening; an inner space in communication with the opening; and an inner peripheral surface defining at least a portion of the inner space. The cam is provided on the camshaft. The cam protrudes outward in a radial direction of the camshaft. At least a portion of the lever is disposed in the inner space of the camshaft. The lever rotates together with the camshaft. The support shaft supports the lever such that the lever is swingable between a first position and a second position relative to the camshaft. The spring is attached to the camshaft. The spring urges the lever toward the first position. The lever includes: a cam portion protruding outward of the camshaft through the opening, with the lever located at the first position; a centrifugal weight on which centrifugal force that moves the lever toward the second position is exerted in accordance with rotation of the camshaft; and an abutment portion that is in abutment with the inner peripheral surface of the camshaft, with the lever located at the first position, and is located away from the inner peripheral surface of the camshaft, with the lever located at the second position.

The compression release mechanism is included in an internal combustion engine. Before the starting of the internal combustion engine, the lever is located at the first position. With the lever located at the first position, an urging force exerted by a valve spring of the internal combustion engine is applied to the cam portion of the lever. The compression release mechanism includes the abutment portion in abutment with the inner peripheral surface of the camshaft, with the lever located at the first position. The urging force of the valve spring applied to the cam portion is thus received by the inner peripheral surface of the camshaft through the abutment portion. Because the compression release mechanism is arranged such that the urging force of the valve spring is received by the inner peripheral surface of the camshaft, the force applied to the support shaft is relatively small. Accordingly, the compression release mechanism enables the support shaft to be smaller in thickness than when the urging force of the valve spring is received by the support shaft. The compression release mechanism also enables the strength of portion(s) of the camshaft supporting the support shaft to be reduced to a level hitherto unattainable by conventional techniques. Consequently, the compression release mechanism is reduced in in size or weight.

As viewed along an axis of the support shaft, with the lever located at the first position, the cam portion and the abutment portion may be respectively disposed on a first side and a second side relative to an axis of the camshaft.

The urging force of the valve spring applied to the cam portion is thus suitably received by the inner peripheral surface of the camshaft through the abutment portion. Consequently, the force applied to the support shaft is further reducible.

As viewed along the axis of the support shaft, with the lever located at the first position, the cam portion and the abutment portion may be disposed on a same straight line perpendicular or substantially perpendicular to the axis of the camshaft.

The urging force of the valve spring is thus rectilinearly transmitted to the inner peripheral surface of the camshaft through the cam portion and the abutment portion. Consequently, the force applied to the support shaft is further reducible.

At least a portion of the camshaft may have a cross-sectional shape including an arc-shaped outer periphery and an arc-shaped inner periphery.

The inner space of the camshaft is thus sufficiently large. This enables the camshaft to be reduced in weight. Consequently, the compression release mechanism is further reduced in weight.

The camshaft may include a first end portion and a second end portion. One or both of the first end portion and the second end portion may be opened.

The camshaft is thus reducible in weight. Consequently, the compression release mechanism is further reduced in weight.

The centrifugal weight of the lever may include a first weight and a second weight respectively located on a first side and a second side relative to a perpendicular line passing through a center of the support shaft and perpendicular or substantially perpendicular to an axis of the camshaft as viewed along an axis of the support shaft, with the lever located at the first position.

The centrifugal weight is thus divided into the first weight and the second weight. This enables each of the first weight and the second weight to be smaller in size than when the centrifugal weight consists of a single weight. Consequently, the lever is suitably placeable inside the camshaft.

The peripheral wall of the camshaft may be provided with a hole. The lever may include a portion that is located inside the hole at least when the lever is located at the second position.

The hole functions as a hole into which the portion of the lever escapes. This makes it possible to prevent the lever and the inner peripheral surface of the camshaft from interfering with each other during movement of the lever. Consequently, the lever is suitably placeable in the inner space of the camshaft.

The support shaft may be disposed on an axis of the camshaft.

The support shaft is thus able to more stably support the lever.

The spring may be a torsion spring.

The lever is thus suitably placeable in the inner space of the camshaft.

An internal combustion engine disclosed herein includes the compression release mechanism.

The internal combustion engine may include a valve that includes a valve body and a valve spring urging the valve body. The compression release mechanism may be arranged such that, with the lever located at the first position, an urging force of the valve spring is applied to the cam portion of the lever.

The internal combustion engine may further include: a cylinder; a piston disposed within the cylinder; a crankshaft coupled to the piston through a connecting rod; a crankshaft sprocket provided on the crankshaft; a cam sprocket provided on the camshaft; and a cam chain wound around the crankshaft sprocket and the cam sprocket. The support shaft may be disposed between an axis of the cylinder and the cam sprocket as viewed along an axis of the support shaft.

Accordingly, various preferred embodiments of the present invention provide a new compression release mechanism reduced in size or weight and an internal combustion engine including the compression release mechanism.

DETAILED DESCRIPTION OF THE PREFERRED EMBODIMENTS

Figure 1:
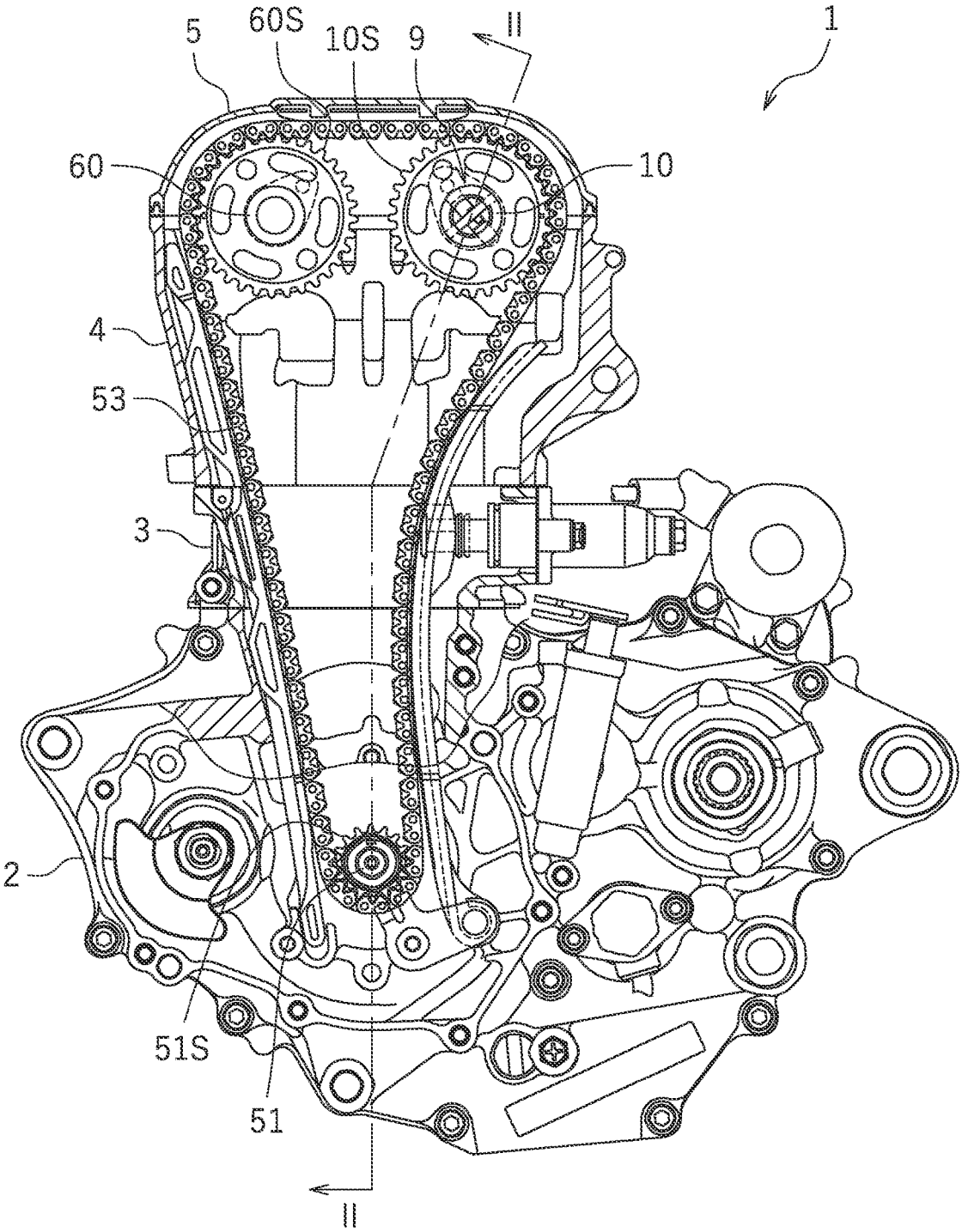
FIG. 1 is a partially cutaway side view of an internal combustion engine according to a preferred embodiment of the present invention.
Figure 2:
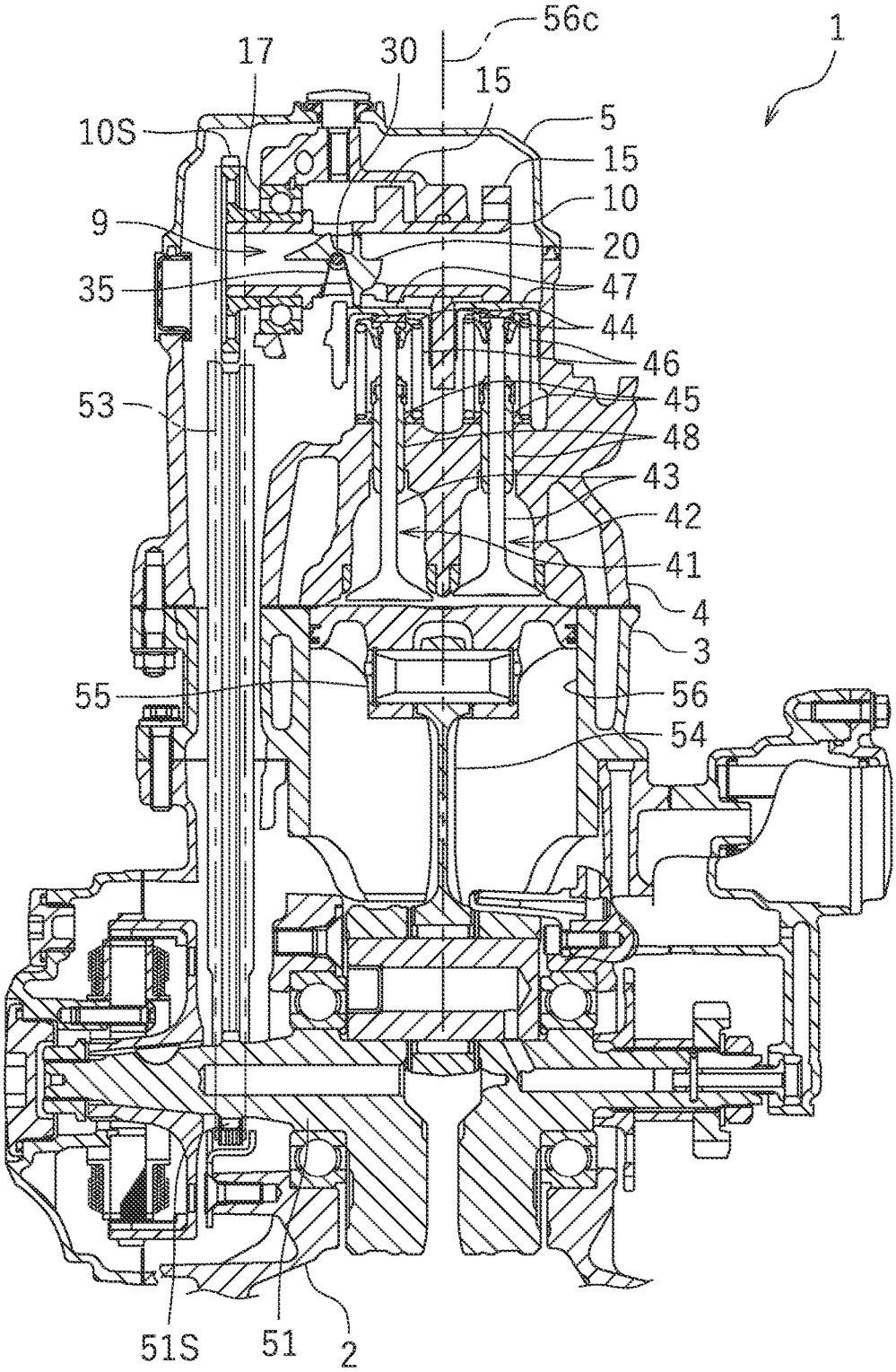
FIG. 2 is a cross-sectional view taken along the line II-II in FIG. 1.

Preferred embodiments of the present invention will be described below with reference to the drawings. FIG. 1 is a partially cutaway side view of an internal combustion engine (hereinafter referred to as an "engine") 1 according to one preferred embodiment of the present invention. FIG. 2 is a cross-sectional view taken along the line II-II in FIG. 1.

As illustrated in FIG. 1, the engine 1 includes: a crankcase 2; a cylinder body 3 connected to the crankcase 2; a cylinder head 4 connected to the cylinder body 3; and a cylinder head cover 5 connected to the cylinder head 4. The engine 1 further includes a crankshaft 51, an intake camshaft 60, an exhaust camshaft 10, and a cam chain 53. A crankshaft sprocket 51S is secured to the crankshaft 51. A cam sprocket 60S is secured to the intake camshaft 60. A cam sprocket 10S is secured to the exhaust camshaft 10. The cam chain 53 is wound around the crankshaft sprocket 51S, the cam sprocket 10S, and the cam sprocket 60S.

As illustrated in FIG. 2, the crankshaft 51 is rotatably supported by the crankcase 2. The cylinder body 3 is provided with a cylinder 56. A piston 55 is disposed in the cylinder 56. The crankshaft 51 is connected to a connecting rod 54. The connecting rod 54 is connected to the piston 55. The crankshaft 51 is coupled to the piston 55 through the connecting rod 54.

The engine 1 includes an exhaust valve 41 and an exhaust valve 42. The exhaust valve 41 and the exhaust valve 42 are attached to the cylinder head 4. Because the exhaust valve 41 and the exhaust valve 42 are similar in arrangement, the arrangement of the exhaust valve 41 will be described below, and the arrangement of the exhaust valve 42 will not be described.

The exhaust valve 41 includes: a valve body 43 that is a poppet valve; an upper spring seat 44 provided on an end portion of the valve body 43; a lower spring seat 45 secured to the cylinder head 4; a valve spring 46 supported by the upper spring seat 44 and the lower spring seat 45; and a lifter 47 provided on the end portion of the valve body 43. A valve guide 48 is attached to the cylinder head 4. The valve body 43 is inserted into the valve guide 48 such that the valve body 43 is slidable through the valve guide 48. The valve spring 46 is disposed between the upper spring seat 44 and the lower spring seat 45. The lifter 47 receives an urging force of the valve spring 46 exerted upward in FIG. 2. The lifter 47 is thus urged toward the exhaust camshaft 10 by the valve spring 46.

The engine 1 includes a compression release mechanism 9. The compression release mechanism 9 is arranged such that the number of times exhaust valve(s) is/are opened and closed or a period of time during which the exhaust valve(s) is/are opened per rotation of an exhaust camshaft differs between before and after the starting of the engine 1. The compression release mechanism 9 thus facilitates the starting of the engine 1 or reduces or prevents vibrations of the engine 1. In the present preferred embodiment, the compression release mechanism 9 is arranged such that the number of times the exhaust valve 41 is opened and closed per rotation of the exhaust camshaft 10 differs between before and after the starting of the engine 1. The compression release mechanism 9 may be arranged to change the timings for opening and closing of the exhaust valve 42. The compression release mechanism 9 includes the exhaust camshaft 10, exhaust cams 15, a lever 20, a support shaft 30, and a spring 35.

Figure 3:
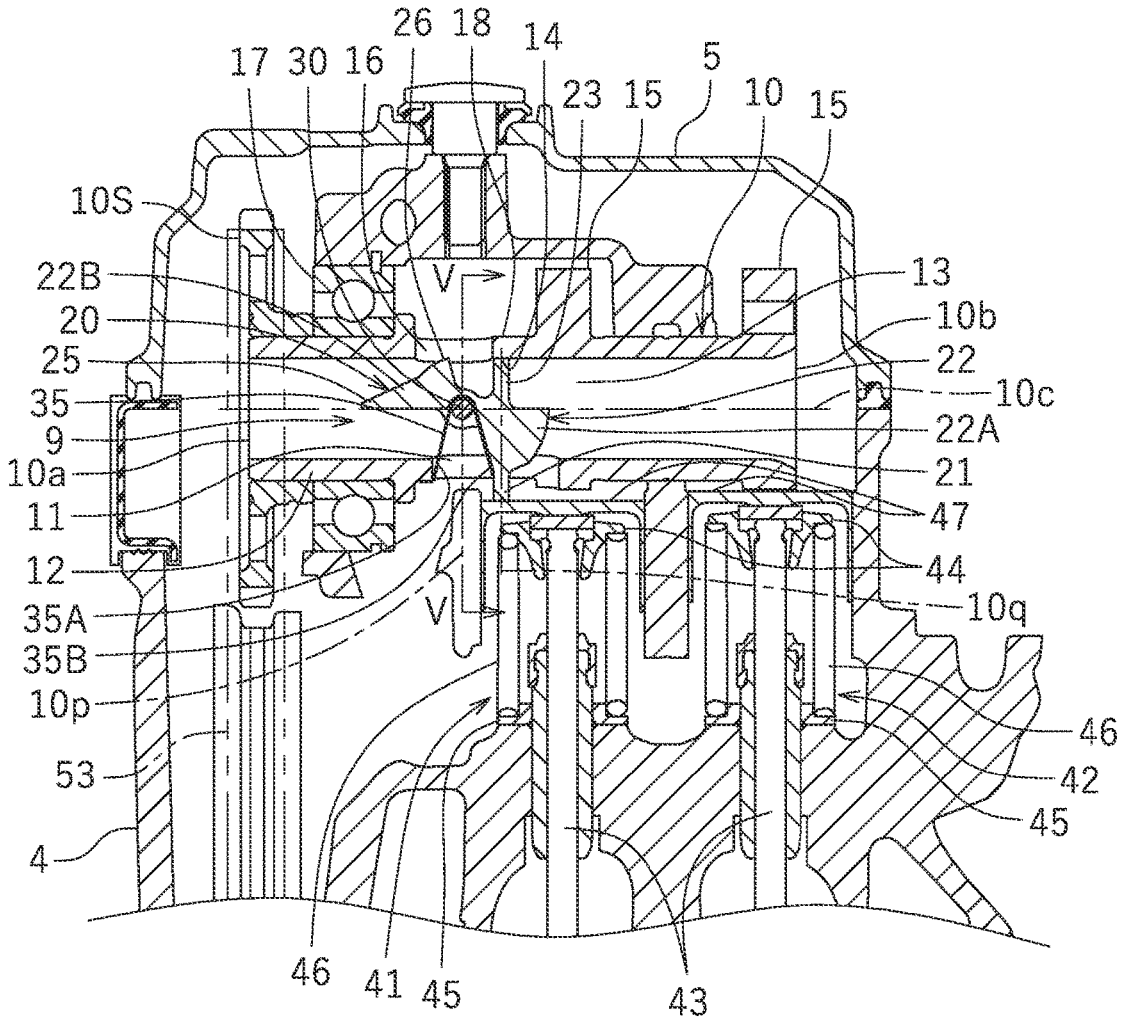
FIG. 3 is a partially enlarged view of FIG. 2.

As illustrated in FIG. 3, the exhaust camshaft 10 is rotatably supported by the cylinder head 4 through a bearing 17. The exhaust camshaft 10 has a hollow structure. At least a portion of the exhaust camshaft 10 has a cross-sectional shape including an arc-shaped outer periphery 10*o* and an arc-shaped inner periphery 10*i* (see FIG. 5). The exhaust camshaft 10 includes: a peripheral wall 12 provided with an opening 11; an inner space 13 in communication with the opening 11; and an inner peripheral surface 14 defining at least a portion of the inner space 13. The exhaust camshaft 10 further includes a first end portion 10*a* and a second end portion 10*b*. The first end portion 10*a* and the second end portion 10*b* are opened along an axis 10*c* of the exhaust camshaft 10. The first end portion 10*a* is provided with the cam sprocket 10S. The peripheral wall 12 is provided with a hole 16.

The exhaust camshaft 10 is provided with a first exhaust cam 15 and a second exhaust cam 15 as the above-mentioned exhaust cams. In this preferred embodiment, the exhaust cams 15 are integral with the exhaust camshaft 10. Alternatively, the exhaust cams 15 may be components separate from the exhaust camshaft 10. The first exhaust cam 15 is disposed at a position where the first exhaust cam 15 is able to come into contact with the lifter 47 of the exhaust valve 41. The second exhaust cam 15 is disposed at a position where the second exhaust cam 15 is able to come into contact with the lifter 47 of the exhaust valve 42. The exhaust cams 15 protrude outward in a radial direction of the exhaust camshaft 10.

Figure 5:
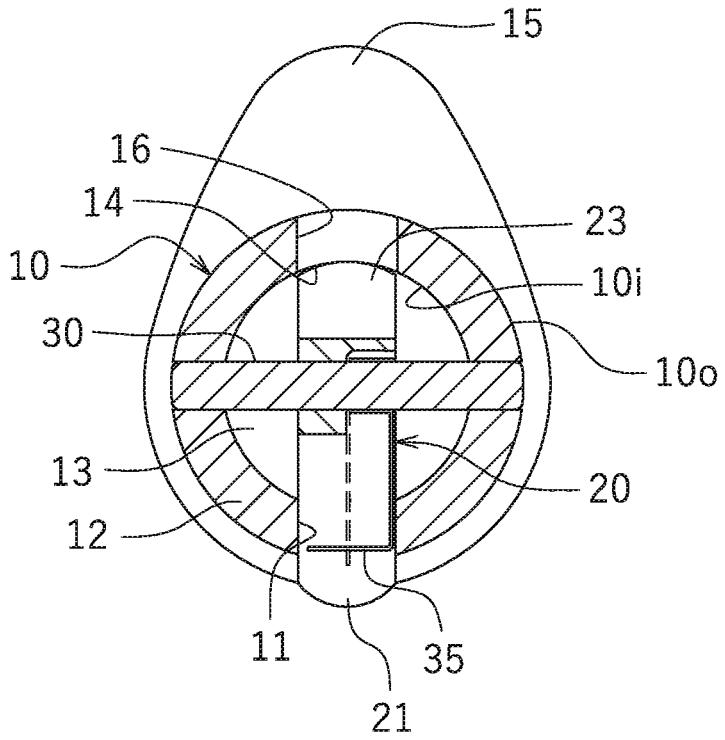
FIG. 5 is a cross-sectional view taken along the line V-V in FIG. 3.

The support shaft 30 is attached to the exhaust camshaft 10. The support shaft 30 is disposed between the first end portion 10*a* and the second end portion 10*b* of the exhaust camshaft 10. As illustrated in FIG. 2, the support shaft 30 is disposed between an axis 56*c* of the cylinder 56 and the cam sprocket 10S as viewed along the axis of the support shaft 30. The support shaft 30 is disposed between the exhaust cams 15 and the cam sprocket 10S. The support shaft 30 is disposed between the exhaust cams 15 and the bearing 17. As illustrated in FIG. 3, the support shaft 30 is disposed such that the support shaft 30 is perpendicular or substantially perpendicular to the axis 10*c* of the exhaust camshaft 10. The support shaft 30 is disposed on the axis 10*c* of the exhaust camshaft 10. As illustrated in FIG. 5, the support shaft 30 is placed across the inner space 13 of the exhaust camshaft 10.

The lever 20 is swingably supported by the support shaft 30. The lever 20 is swingable between a first position illustrated in FIG. 3 and a second position illustrated in FIG. 4. At least a portion of the lever 20 is disposed in the inner space 13. Because the support shaft 30 rotates together with the exhaust camshaft 10, the lever 20 rotates around the axis 10*c* together with the exhaust camshaft 10.

The lever 20 includes a cam portion 21, a centrifugal weight 22, and an abutment portion 23. With the lever 20 located at the first position, the cam portion 21 protrudes outward of the exhaust camshaft 10 through the opening 11. In accordance with rotation of the exhaust camshaft 10, centrifugal force that moves the lever 20 toward the second position is exerted on the centrifugal weight 22. With the lever 20 located at the first position, the abutment portion 23 is in abutment with the inner peripheral surface 14 (see FIG. 3). With the lever 20 located at the second position, the abutment portion 23 is located away from the inner peripheral surface 14 (see FIG. 4).

Figure 4:
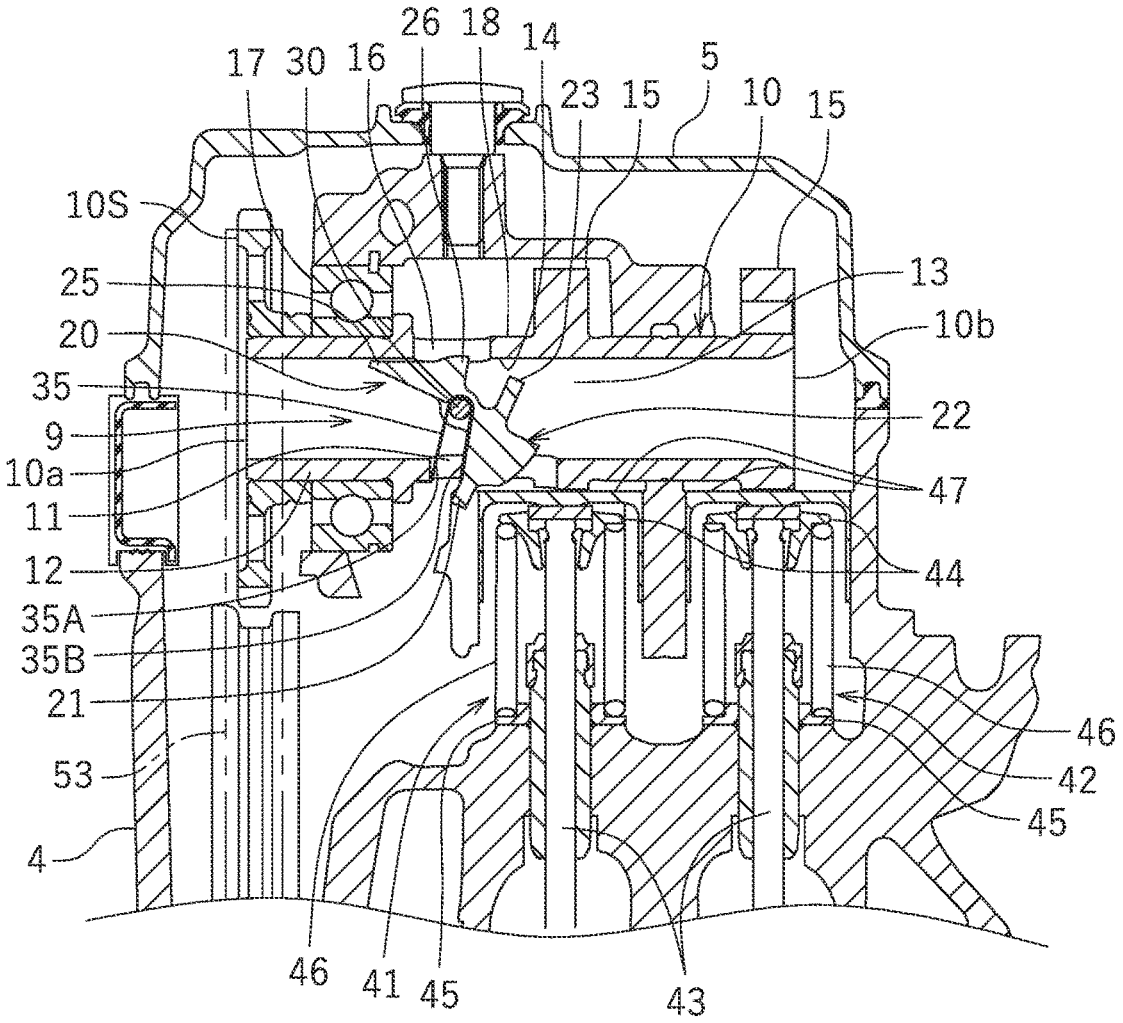
FIG. 4 is a diagram equivalent to FIG. 3, with a lever located at a second position.

As illustrated in FIG. 4, the lever 20 includes a portion 26 that is located inside the hole 16 of the exhaust camshaft 10 at least when the lever 20 is located at the second position. With the lever 20 located at the second position, the portion 26 is located radially outward of the inner peripheral surface 14 of the exhaust camshaft 10. With the lever 20 located at the second position, the portion 26 is located radially inward of an outer peripheral surface 18 of the exhaust camshaft 10. Alternatively, with the lever 20 located at the second position, the portion 26 may be located radially outward of the outer peripheral surface 18 of the exhaust camshaft 10. With the lever 20 located at the second position, the portion 26 may protrude outward of the exhaust camshaft 10 through the hole 16. The portion 26 may be formed such that the portion 26 is located inside the hole 16, with the lever 20 located at the first position.

The centrifugal weight 22 may be a single portion. In the present preferred embodiment, however, the centrifugal weight 22 includes a first weight 22A and a second weight 22B. In FIG. 3, a line 10*p* is a straight line passing through the center of the support shaft 30 and perpendicular or substantially perpendicular to the axis 10*c* of the exhaust camshaft 10. The perpendicular line 10*p* is perpendicular or substantially perpendicular to both of the axis of the support shaft 30 and the axis 10*c* of the exhaust camshaft 10. The first weight 22A is located on a first side relative to the perpendicular line 10*p*. The second weight 22B is located on a second side relative to the perpendicular line 10*p*. In FIG. 3, the first weight 22A is located to the right of the perpendicular line 10*p*, and the second weight 22B is located to the left of the perpendicular line 10*p*.

As illustrated in FIG. 3, the cam portion 21 and the abutment portion 23 are respectively disposed on a first side and a second side relative to the axis 10*c* of the exhaust camshaft 10 as viewed along the axis of the support shaft 30, with the lever 20 located at the first position. In this preferred embodiment, the cam portion 21 is disposed below the axis 10*c* of the exhaust camshaft 10, and the abutment portion 23 is disposed above the axis 10*c* of the exhaust camshaft 10.

As viewed along the axis of the support shaft 30, with the lever 20 located at the first position, the cam portion 21 and the abutment portion 23 are disposed on a straight line 10*q* perpendicular or substantially perpendicular to the axis 10*c* of the exhaust camshaft 10. The cam portion 21 and the abutment portion 23 are disposed at identical positions in a direction along the axis 10*c*.

In the present preferred embodiment, the spring 35 is a torsion spring. The spring 35 is attached to the support shaft 30. The spring 35 is attached to the exhaust camshaft 10 through the support shaft 30. A first end portion 35A of the spring 35 is in engagement with the exhaust camshaft 10. In this preferred embodiment, the first end portion 35A of the spring 35 is in engagement with the opening 11 of the exhaust camshaft 10. A second end portion 35B of the spring 35 is in engagement with the lever 20. The spring 35 urges the lever 20 toward the first position. In FIG. 3, the spring 35 urges the lever 20 in a counterclockwise direction around the support shaft 30.

As illustrated in FIG. 3, the lever 20 is located at the first position before the starting of the engine 1. Before the starting of the engine 1, the cam portion 21 of the lever 20 protrudes from the exhaust camshaft 10 through the opening 11. The cam portion 21 comes into contact with the lifter 47 of the exhaust valve 41. An urging force exerted by the valve spring 46 of the exhaust valve 41 is applied to the cam portion 21.

With the lever 20 located at the first position, the abutment portion 23 of the lever 20 is in abutment with the inner peripheral surface 14 of the exhaust camshaft 10. The urging force of the valve spring 46 applied to the cam portion 21 is received by the inner peripheral surface 14 of the exhaust camshaft 10 through the abutment portion 23. This reduces the force applied to the support shaft 30.

Following the starting of the engine 1, the exhaust camshaft 10 rotates. In accordance with the rotation of the exhaust camshaft 10, the lever 20 rotates around the axis 10*c* of the exhaust camshaft 10. This exerts centrifugal force on the centrifugal weight 22. More specifically, the rotation of the lever 20 exerts centrifugal force on each of the first weight 22A and the second weight 22B. The centrifugal force acts on the lever 20 such that the lever 20 moves toward the second position. In FIG. 3, the centrifugal force acts on the lever 20 such that the lever 20 is rotated in a clockwise direction around the support shaft 30. Upon exceeding an urging force of the spring 35, the centrifugal force exerted on the centrifugal weight 22 moves the lever 20 from the first position to the second position.

As illustrated in FIG. 4, the movement of the lever 20 to the second position brings the cam portion 21 away from the lifter 47 of the exhaust valve 41. The cam portion 21 moves to a position where the cam portion 21 is out of contact with the lifter 47. The abutment portion 23 moves away from the inner peripheral surface 14 of the exhaust camshaft 10. The portion 26 of the lever 20 moves into the hole 16 of the exhaust camshaft 10. Another portion 25 of the lever 20 comes into abutment with the inner peripheral surface 14 of the exhaust camshaft 10. The lever 20 is thus held at the second position. The exhaust valve 41 is pressed by the first exhaust cam 15 periodically and is thus opened and closed periodically.

The arrangements of the compression release mechanism 9 and the engine 1 according to the present preferred embodiment have been described thus far. Various effects achieved by the present preferred embodiment will be described below.

As illustrated in FIG. 3, the lever 20 of the compression release mechanism 9 according to the present preferred embodiment includes the abutment portion 23 that is in abutment with the inner peripheral surface 14 of the exhaust camshaft 10, with the lever 20 located at the first position. Before the starting of the engine 1, the urging force of the valve spring 46 is applied to the lever 20. The urging force, however, is received by the inner peripheral surface 14 of the exhaust camshaft 10 through the abutment portion 23. The present preferred embodiment thus makes it unnecessary for the support shaft 30 to receive an entirety of the urging force of the valve spring 46. A major portion or an entirety of the urging force of the valve spring 46 is received by the inner peripheral surface 14 of the exhaust camshaft 10. This reduces the force applied to the support shaft 30. Accordingly, the compression release mechanism 9 enables the support shaft 30 to be reduced in thickness. The compression release mechanism 9 also enables the strength of portion(s) of the exhaust camshaft 10 supporting the support shaft 30 to be reduced to a level hitherto unattainable by conventional techniques. Consequently, the compression release mechanism 9 is reduced in size or weight.

In the present preferred embodiment, the cam portion 21 and the abutment portion 23 are respectively disposed on the first side and the second side relative to the axis 10*c* of the exhaust camshaft 10 as viewed along the axis of the support shaft 30, with the lever 20 located at the first position. The urging force of the valve spring 46 applied to the cam portion 21 is thus suitably received by the inner peripheral surface 14 of the exhaust camshaft 10 through the abutment portion 23. Consequently, the force applied to the support shaft 30 is further reducible.

In the present preferred embodiment, the cam portion 21 and the abutment portion 23 are disposed on the same straight line 10*q* perpendicular or substantially perpendicular to the axis 10*c* of the exhaust camshaft 10 as viewed along the axis of the support shaft 30, with the lever 20 located at the first position. The urging force of the valve spring 46 is thus rectilinearly transmitted to the inner peripheral surface 14 of the exhaust camshaft 10 through the cam portion 21 and the abutment portion 23. Consequently, the force applied to the support shaft 30 is further reducible.

Figure 6:
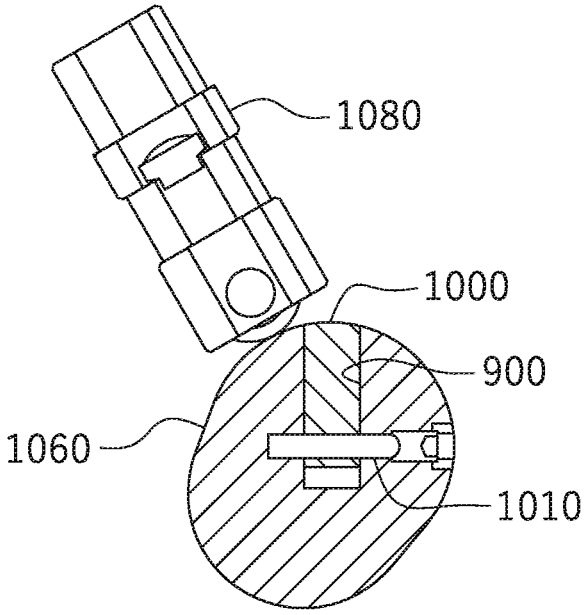
FIG.6 PRIOR ART
FIG. 6 is a cross-sectional view of a compression release mechanism known in the related art.
Figure 7:
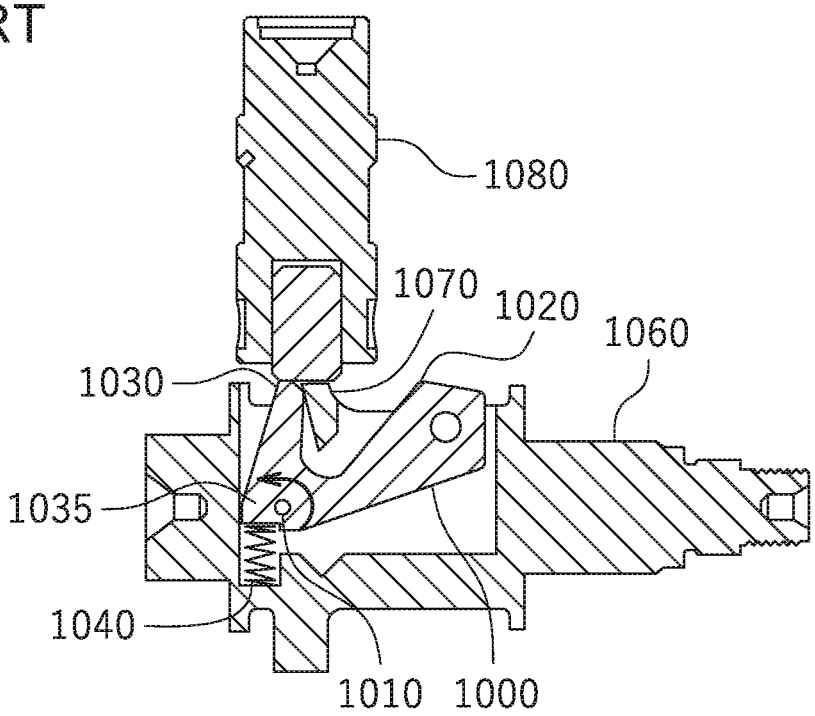
FIG.7 PRIOR ART
FIG. 7 is a longitudinal sectional view of the compression release mechanism known in the related art.

In the present preferred embodiment, the exhaust camshaft 10 has a tubular shape. As illustrated in FIG. 5, at least a portion of the exhaust camshaft 10 has a cross-sectional shape including the arc-shaped outer periphery 10*o* and the arc-shaped inner periphery 10*i*. The inner space 13 of the exhaust camshaft 10 is thus larger than an inner space of a camshaft known in the related art, which is defined by a long and narrow groove (see FIG. 6). This enables the exhaust camshaft 10 to be further reduced in weight. Consequently, the compression release mechanism 9 is further reduced in weight.

The first end portion 10*a* or the second end portion 10*b* of the exhaust camshaft 10 may be closed. In the present preferred embodiment, however, the first end portion 10*a* and the second end portion 10*b* are opened as illustrated in FIG. 3. This enables the exhaust camshaft 10 to be further reduced in weight. Consequently, the compression release mechanism 9 is further reduced in weight.

In the present preferred embodiment, the centrifugal weight 22 of the lever 20 includes the first weight 22A and the second weight 22B respectively located on the first side and the second side relative to the perpendicular line 10*p* as viewed along the axis of the support shaft 30, with the lever 20 located at the first position. The centrifugal weight 22 is divided into the first weight 22A and the second weight 22B. The present preferred embodiment is thus able to make a per-piece weight size smaller than when the centrifugal weight 22 consists of a single weight. Accordingly, the centrifugal weight 22 is unlikely to hinder placement of the lever 20 in the inner space 13 of the exhaust camshaft 10. Consequently, the lever 20 is suitably placeable inside the exhaust camshaft 10.

In the present preferred embodiment, the peripheral wall 12 of the exhaust camshaft 10 is provided with the hole 16 in addition to the opening 11. As illustrated in FIG. 4, with the lever 20 located at the second position, the portion 26 of the lever 20 is located inside the hole 16. During movement of the lever 20 from the first position to the second position, the hole 16 functions as a hole into which the portion 26 of the lever 20 escapes. This makes it possible to prevent the lever 20 and the inner peripheral surface 14 of the exhaust camshaft 10 from interfering with each other before the lever 20 reaches the second position. Consequently, the lever 20 is suitably placeable in the inner space 13 of the exhaust camshaft 10.

The position of the support shaft 30 is not limited to any particular position. In the present preferred embodiment, the support shaft 30 is disposed on the axis 10*c* of the exhaust camshaft 10 (see FIG. 3). The support shaft 30 is disposed in the center of the exhaust camshaft 10 in a radial direction of the exhaust camshaft 10. The support shaft 30 is thus able to more stably support the lever 20.

In the present preferred embodiment, the spring 35, which urges the lever 20 toward the first position, is a torsion spring. The lever 20 and the spring 35 are thus suitably placeable in the inner space 13 of the exhaust camshaft 10.

In the present preferred embodiment, the inner space 13 may be created by inserting a drill into the exhaust camshaft 10 from its one end portion along the axis 10*c*. The present preferred embodiment thus requires no machining process for cutting the exhaust camshaft 10 in its radial direction except cutting hole(s) into which the support shaft 30 is to be inserted, the opening 11, and the hole 16. Consequently, the exhaust camshaft 10 is machinable in a shorter time and at a lower cost than conventional techniques that involve providing a groove long and narrow in a radial direction of a camshaft (see FIG. 6).

Although one preferred embodiment of the present invention has been described thus far, the above-described preferred embodiment is presented by way of example only. Various other preferred embodiments are possible. Examples of the other preferred embodiments will be briefly described below. The other preferred embodiments described below may be carried out solely or may be carried out in combination when appropriate.

As viewed along the axis of the support shaft 30, with the lever 20 located at the first position, both of the cam portion 21 and the abutment portion 23 may be disposed on the same side relative to the axis 10*c* of the exhaust camshaft 10. Referring to, for example, FIG. 3, the abutment portion 23 may be disposed below the axis 10*c*.

As viewed along the axis of the supporting shaft 30, with the lever 20 located at the first position, the cam portion 21 and the abutment portion 23 do not necessarily have to be disposed on the same straight line 10*q* perpendicular or substantially perpendicular to the axis 10*c* of the exhaust camshaft 10. Referring to, for example, FIG. 3, the abutment portion 23 may be disposed leftward or rightward of the cam portion 21.

The exhaust camshaft 10 does not necessarily have to have a tubular shape. The exhaust camshaft 10 does not necessarily have to have a cross-sectional shape including the arc-shaped outer periphery 10*o* and the arc-shaped inner periphery 10*i*. In one example, the exhaust camshaft 10 may be provided with a groove that is long and narrow as viewed along the axis 10*c*, and the lever 20 may be disposed inside the groove.

The centrifugal weight 22 of the lever 20 does not necessarily have to include the first weight 22A and the second weight 22B. The centrifugal weight 22 may be a single weight.

The exhaust camshaft 10 does not necessarily have to include the hole 16 when the lever 20 does not interfere with the inner peripheral surface 14 of the exhaust camshaft 10 during movement of the lever 20 from the first position to the second position.

The spring 35, which urges the lever 20 toward the first position, is not limited to a torsion spring. The spring 35 may be, for example, a coil spring.

In the above-described preferred embodiment, the compression release mechanism 9 is arranged such that the number of times the exhaust valve 41 is opened and closed per rotation of the exhaust camshaft 10 is changeable and the number of times the exhaust valve 42 is opened and closed per rotation of the exhaust camshaft 10 is unchangeable. In the above-described preferred embodiment, no lever 20 is provided for the exhaust valve 42. Alternatively, the lever 20 may be provided for the exhaust valve 42. The compression release mechanism 9 may be arranged such that the number of times the exhaust valve 41 is opened and closed is unchangeable and the number of times the exhaust valve 42 is opened and closed is changeable. The compression release mechanism 9 may be arranged such that the number of times the exhaust valve 41 is opened and closed and the number of times the exhaust valve 42 is opened and closed are both changeable. The lever 20 may be provided for both of the exhaust valve 41 and the exhaust valve 42. The number of support shafts 30 and the number of levers 20 provided for the exhaust camshaft 10 are each not limited to one. In one example, the number of support shafts 30 and the number of levers 20 provided for the exhaust camshaft 10 may each be two.

The engine 1 according to the above-described preferred embodiment is a single-cylinder engine including only one cylinder 56. An engine including the compression release mechanism 9, however, may be a multi-cylinder engine including two or more cylinders. In the case of a multi-cylinder engine, the compression release mechanism 9 may be provided only for a single cylinder or may be provided for two or more cylinders. For a single exhaust camshaft 10, for example, the compression release mechanism 9 may include a first support shaft 30 and a first lever 20 provided for a first cylinder, and a second support shaft 30 and a second lever 20 provided for a second cylinder.

In the above-described preferred embodiment, the compression release mechanism 9 is arranged such that the cam portion 21 of the lever 20 directly presses the exhaust valve 41. Alternatively, the compression release mechanism 9 may be arranged such that the cam portion 21 of the lever 20 indirectly presses the exhaust valve 41 through a rocker arm (not illustrated). The compression release mechanism 9 may be arranged such that the urging force of the valve spring 46 is applied to the lever 20 through the rocker arm.

The engine 1 is suitably usable as, for example, a driving source for a vehicle. The vehicle may be a straddled vehicle. As used herein, the term "straddled vehicle" refers to any vehicle that a rider straddles when riding on the vehicle. The straddled vehicle may be, for example, a motorcycle, a motor tricycle, an all-terrain vehicle (ATV), or a snowmobile.

The terms and expressions used herein are for description only and are not to be interpreted in a limited sense. These terms and expressions should be recognized as not excluding any equivalents of features shown and described herein and as allowing various modifications falling within the claimed scope of the present invention. The present invention may be embodied in many various forms. This disclosure should be regarded as providing embodiments of the principles of the present invention. These embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions, combinations, improvements, and/or alterations which may be recognized by a person of ordinary skill in the art based on the disclosure. The limitations in the claims are to be interpreted broadly based on the terms used in the claims and not limited to the embodiments described in this specification or during the prosecution of the present application.

What is claimed is:

1. A compression release mechanism comprising:

a hollow camshaft including:

a peripheral wall having an outer peripheral surface and an inner peripheral surface, a cam protruding radially outwardly from the outer peripheral surface, an inner space at least partially defined by the inner peripheral surface, and a radial opening formed in the peripheral wall so as to communicate with the inner space;

a lever at least partially disposed in the inner space, the lever configured to rotate together with the camshaft about an axis of the camshaft;

a support shaft extending perpendicular to the axis of the camshaft, the support shaft configured to pivotally support the lever such that the lever is further configured to switch between a first position and a second position relative to the camshaft; and a spring attached to the camshaft, the spring urging the lever toward the first position, wherein the lever includes:

a cam portion configured to protrude outwardly through the opening when the lever is in the first position, a centrifugal weight configured to exert a centrifugal force against the spring so as to move the lever toward the second position in accordance with rotation of the camshaft, and an abutment portion configured to abut the inner peripheral surface when the lever is in the first position, and to separate from the inner peripheral surface as the lever moves toward the second position.

2. The compression release mechanism according to claim 1, wherein:

when the lever is in the first position, the cam portion and the abutment portion are diametrically opposed to each other with respect to the camshaft.

3. The compression release mechanism according to claim 2, wherein:

when the lever is in the first position, the cam portion and the abutment portion are aligned along a straight line perpendicular to the axis of the camshaft.

4. The compression release mechanism according to claim 1, wherein:

at least at a portion of the camshaft, the outer peripheral surface and the inner peripheral surface are arc-shaped.

5. The compression release mechanism according to claim 1, wherein:

the camshaft further includes a first end portion and a second end portion, and at least one of the first end portion and the second end portion is opened to the inner space.

6. The compression release mechanism according to claim 1, wherein:

the centrifugal weight includes a first weight and a second weight, and when the lever is in the first position, the support shaft is arranged between the first weight and the second weight in a longitudinal direction of the camshaft.

7. The compression release mechanism according to claim 1, wherein:

the camshaft further includes a radial hole formed in the peripheral wall, and a portion of the lever is located inside the hole at least when the lever is in the second position.

8. The compression release mechanism according to claim 1, wherein the support shaft intersects the axis of the camshaft.

9. The compression release mechanism according to claim 1, wherein the spring is a torsion spring.

10. An internal combustion engine comprising the compression release mechanism according to claim 1.

11. The internal combustion engine according to claim 10, further comprising:

a valve including a valve body and a valve spring urging the valve body toward a closed position, wherein when the lever is in the first position, an urging force of the valve spring is applied to the cam portion of the lever.

12. The internal combustion engine according to claim 10, further comprising:

a cylinder;

a piston disposed within the cylinder;

a crankshaft coupled to the piston via a connecting rod;

a crankshaft sprocket provided on the crankshaft;

a cam sprocket provided on the camshaft; and a cam chain wound around the crankshaft sprocket and the cam sprocket, wherein the support shaft is disposed between an axis of the cylinder and the cam sprocket in a longitudinal direction of the camshaft.

* * * * *